US009624660B2

(12) United States Patent
Martel

(10) Patent No.: US 9,624,660 B2
(45) Date of Patent: Apr. 18, 2017

(54) INSULATIVE BUILDING PANELS

(71) Applicant: Thermo-Clad Technologies Inc., Oakville (CA)

(72) Inventor: Nicholas Martel, Oakville (CA)

(73) Assignee: Thermo-Clad Technologies Inc. (CA)

( * ) Notice: Subject to any disclaimer, the term of this patent is extended or adjusted under 35 U.S.C. 154(b) by 0 days.

(21) Appl. No.: 15/150,213

(22) Filed: May 9, 2016

(65) Prior Publication Data

US 2016/0326739 A1 Nov. 10, 2016

Related U.S. Application Data

(60) Provisional application No. 62/158,787, filed on May 8, 2015.

(51) Int. Cl.

| | |
|---|---|
| ***E04B 1/70*** | (2006.01) |
| ***E04B 1/61*** | (2006.01) |
| *E04B 2/02* | (2006.01) |
| *E04F 13/08* | (2006.01) |

(52) U.S. Cl.

CPC ..... *E04B 1/7069* (2013.01); *E04B 1/612* (2013.01); *E04B 1/6187* (2013.01); *E04B 1/7076* (2013.01); *E04F 13/0846* (2013.01); *E04F 13/0876* (2013.01); *E04B 2002/0202* (2013.01); *E04B 2002/0282* (2013.01); *E04F 13/0869* (2013.01)

(58) Field of Classification Search

CPC ..... E04B 1/7069; E04B 1/6187; E04B 2/02; E04B 1/612; E04B 1/7076; E04B 2002/0282; E04B 2002/0202; E04F 13/007; E04F 17/04

See application file for complete search history.

(56) References Cited

U.S. PATENT DOCUMENTS

| | | | | |
|---|---|---|---|---|
| 2,318,820 A * | 5/1943 | Voigt | E04B 1/7069 | 428/182 |
| 4,439,960 A * | 4/1984 | Jenkins | E04C 2/292 | 52/396.04 |
| 4,606,160 A * | 8/1986 | Kubbutat | E04F 13/007 | 52/235 |

(Continued)

FOREIGN PATENT DOCUMENTS

| | | | |
|---|---|---|---|
| DE | 3308469 A1 * | 9/1984 | E04B 1/7612 |
| EP | 151993 A2 * | 8/1985 | E04B 1/76 |

*Primary Examiner* — Jeanette E Chapman

(74) *Attorney, Agent, or Firm* — Eric L. Sophir; Dentons US LLP

(57) ABSTRACT

A panel is disclosed for use in insulating an edifice that includes a first pane, a second pane in engagement with the first pane so as to define a channel therebetween configured and dimensioned for drainage and air flow, a clip in engagement with the first and second panes, and an insulator including an upper portion that is positioned within the clip. A system for use in insulating an edifice includes identical panels, wherein the insulator of one panel is positionable within the clip of another panel to connect the panels together. A panel clip for use in insulating an edifice includes a first arm defining an outer surface with a plurality of connectors, a saddle extending from the first arm, and a second arm connected to the saddle opposite the first arm such that the clip is generally H-shaped in configuration.

17 Claims, 10 Drawing Sheets

(56) References Cited

U.S. PATENT DOCUMENTS

| | | | | |
|---|---|---|---|---|
| 6,195,948 | B1 * | 3/2001 | Lamanna | E04D 13/0305 52/200 |
| 7,748,181 | B1 * | 7/2010 | Guinn | E04C 2/292 52/235 |
| 8,898,984 | B2 * | 12/2014 | Winteler | E04F 13/045 52/404.1 |
| 2004/0006945 | A1 * | 1/2004 | Price | E04B 2/06 52/605 |

* cited by examiner

INSULATIVE BUILDING PANELS

CROSS-REFERENCE TO RELATED APPLICATION

The present application claims benefit of U.S. Provisional Application No. 62/158,787, filed May 8, 2015, entitled INSULATIVE BUILDING PANELS, the entire contents of which are hereby incorporated by reference.

FIELD OF THE DISCLOSURE

The present disclosure relates generally to insulative technologies and structures, and more particularly, to improved insulation panels, e.g., for use in insulating edifices, such as residential and commercial buildings.

BACKGROUND

The incorporation of a wall cavity to increase thermal resistance began more than 350 years ago with a post-and-beam construction method known as wattle and daub. While there have been advancements in the materials of construction, the construction methods themselves have remained much the same, without any significant variation in the employment of stud and cavity insulation.

Industry practice (for residential buildings) typically includes latex-painted ½" gypsum board, a 6 mm poly vapor barrier, 2"×4" or 2"×6" cavity insulated framing, ½" plywood or OSB sheathing, Tyvek house wrap, a ½"-¾" air gap, and brick masonry cladding. This method, however, presents certain inefficiencies and challenges. For example, moist air often penetrates the building envelope, which contacts the vapor barrier and becomes heated by the indoor climate only to cool and condense, thereby dampening the insulation contained within the wall cavity. This dampening not only renders the insulation less efficient, but can cause a build-up of moisture resulting in the growth of mold spores, which can ultimately spread through the wall and into the interior of the building. Additionally, known methods of insulation are not only time-consuming, but often complex, expensive, and prone to energy losses that result in thousands of dollars per year in wasted heating costs.

Accordingly, there remains a need for insulation and methodologies that can be employed easily in a cost-effective manner to reduce energy loss.

SUMMARY

In one aspect of the present disclosure, a panel is disclosed for use in insulating an edifice that includes a first pane, a second pane in engagement with the first pane so as to define a channel therebetween, a clip in engagement with the first and second panes, and an insulator including an upper portion positioned within the clip.

In certain embodiments, the first and second panes may each include a plurality of engageable connectors to facilitate connection of the first and second panes.

In certain embodiments, the connectors on the first pane may be positioned on an inner surface of the first pane, and the connectors on the second pane may be positioned on an inner surface of the second pane facing the inner surface of the first pane.

In certain embodiments, the connectors on the first and second panes may be fused together.

In certain embodiments, the clip may include an inner arm, an outer arm, and a saddle that extends between the inner and outer arms.

In certain embodiments, the clip may be generally H-shaped in configuration.

In certain embodiments, the inner and outer arms may each define a length, wherein the length of the inner arm is greater than the length of the outer arm so as to define an extension that is configured and dimensioned to receive a plurality of fasteners to facilitate connection of the panel to the edifice.

In certain embodiments, the clip may define first and second chambers that are positioned between the inner and outer arms on opposite sides of the saddle. In such embodiments, the second chamber may be configured and dimensioned to receive the insulator.

In another aspect of the present disclosure, a system is disclosed for use in insulating an edifice, including first and second panels that are configured and dimensioned for engagement with each other.

The first panel includes inner and outer panes defining a channel therebetween, a clip in engagement with the inner and outer panes, and an insulator including an upper portion that is positioned within the clip.

The second panel includes inner and outer panes defining a channel therebetween that is configured and dimensioned for drainage and air flow, a clip in engagement with the inner and outer panes, and an insulator including an upper portion positioned within the clip of the second panel, and a lower portion positionable within the clip of the first panel.

In certain embodiments, the first and second panels may be identical.

In certain embodiments, the inner and outer panes of the first and second panels may each include a plurality of engageable connectors to facilitate connection of the first and second panes. In certain embodiments, the connectors may be located within the channels defined between the inner and outer panes. In certain embodiments, the connectors included on each inner pane may be fused to the connectors included on each outer pane.

In certain embodiments, the clip of each panel may include a first arm, a second arm, and a saddle that extends between the first and second arms so as to define upper and lower chambers positioned between the first and second arms on opposite sides of the saddle.

In certain embodiments, the first and second panels may be arranged in vertical relation. In other embodiments, the first and second panels may be arranged in horizontal relation.

In certain embodiments, the insulator of the second panel may be positionable within the upper chamber defined by the clip of the first panel.

In another aspect of the present disclosure, a panel clip is disclosed for use in insulating an edifice. The panel clip includes a first arm defining an outer surface having a plurality of connectors, a saddle that extends from the first arm, and a second arm that is connected to the saddle opposite the first arm such that the clip is generally H-shaped in configuration.

The first and second arms of the panel clip each define a length. In certain embodiments, the length of the first arm may be greater than the length of the second arm so as to define an extension configured and dimensioned to receive a plurality of fasteners.

In certain embodiments, a system for use in insulating an edifice incorporates a starter track, which is a portion of the system that is configured to secure insulative panels to the foundation wall of the edifice. In an embodiment, the starter track is configured, dimensioned, and adapted to receive a lowermost set of insulative panels including panes and an insulator and to secure these insulative panels including panes and an insulator to the foundation wall of the edifice.

In an embodiment, a panel for use in insulating an edifice comprises a first pane; a second pane in engagement with the first pane so as to define a channel therebetween; a clip in engagement with the first and second panes; and an insulator including an upper portion positioned within the clip.

In an embodiment, a system for use in insulating an edifice, comprises a first panel comprising first inner and outer panes defining a first channel therebetween; a first clip in engagement with the first inner and outer panes; and a first insulator including an upper portion positioned within the first clip; and a second panel engageable with the first panel, the second panel comprising second inner and outer panes defining a second channel therebetween configured and for drainage and air flow; a second clip in engagement with the second inner and outer panes; and a second insulator including an upper portion positioned within the second clip of the second panel, and a lower portion positionable within the first clip of the first panel.

In an embodiment, a panel clip for use in insulating an edifice, the panel clip comprising a first arm defining an outer surface including a plurality of connectors; a saddle extending from the first arm; and a second arm connected to the saddle opposite the first arm such that the panel clip is generally H-shaped in configuration.

Additional features and advantages of an embodiment will be set forth in the description which follows, and in part will be apparent from the description. The objectives and other advantages of the invention will be realized and attained by the structure particularly pointed out in the exemplary embodiments in the written description and claims hereof, as well as the appended drawings.

It is to be understood that both the foregoing general description and the following detailed description are exemplary and explanatory and are intended to provide further explanation of the invention as claimed.

BRIEF DESCRIPTION OF THE FIGURES

The present disclosure can be better understood by referring to the following figures. The components in the figures are not necessarily to scale, emphasis instead being placed upon illustrating the principles of the disclosure. In the figures, reference numerals designate corresponding parts throughout the different views.

DETAILED DESCRIPTION

Figure 1:
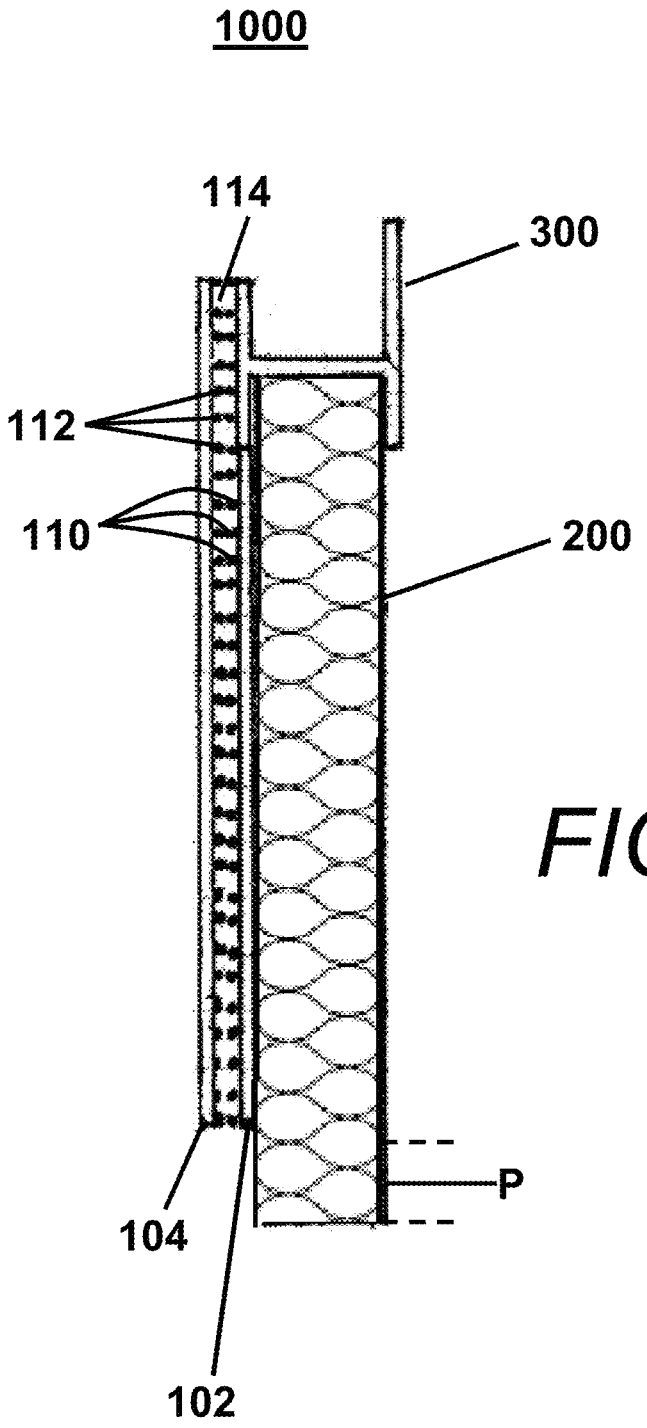
FIG. 1 is a side, cross-sectional view of an insulative panel according to the principles of the present disclosure that includes inner and outer panes, an insulator, and a clip, in accordance with an embodiment.

The present disclosure is here described in detail with reference to embodiments illustrated in the drawings, which form a part here. Other embodiments may be used and/or other changes may be made without departing from the spirit or scope of the present disclosure. The illustrative embodiments described in the detailed description are not meant to be limiting of the subject matter presented here.

Reference will now be made to the exemplary embodiments illustrated in the drawings, and specific language will be used here to describe the same. It will nevertheless be understood that no limitation of the scope of the invention is thereby intended. Alterations and further modifications of the inventive features illustrated here, and additional applications of the principles of the inventions as illustrated here, which would occur to one skilled in the relevant art and having possession of this disclosure, are to be considered within the scope of the invention. Throughout the present disclosure, the terms "front," "rear," "upper," "lower," "inner," "outer," etc. are used in a relative capacity, and should be interpreted in accordance with the perspective shown in the corresponding figure(s).

This specification relates generally to insulative technologies and structures, and more particularly, to improved insulation panels for use in insulating an edifice in residential and/or commercial applications, e.g., a home, an office building, etc., and provide a number of benefits over known technologies. For example, the present disclosure describes insulative panels, and corresponding methods of use and installation, that can be easier to install than conventional insulation and more resistant to thermal energy losses.

With reference to FIGS. 1-4, an insulative panel 1000 is disclosed that includes respective inner and outer panes 102, 104, an insulator 200, and a clip 300.

The panes 102, 104 may be formed from any suitable insulative material, i.e., any material that limits heat conduction. For example, in one embodiment, the panes 102, 104 may be formed from polyethylene terephthalate (PET), e.g., to reduce material costs, and incorporate a "green" material.

The panes 102, 104 include respective inner surfaces 106, 108 (FIG. 2) having a plurality of connectors 110, 112 that are configured and dimensioned for mating engagement. For example, the connectors 110, 112 may be configured and dimensioned for mechanical engagement, e.g., in a pressure-fit or snap-fit manner, or may be fused together, e.g., through the use of an adhesive, such as contact cement, or through the application of heat. Upon mating engagement of the connectors 110, 112, an interior channel 114 (FIG. 1) is created that is configured and dimensioned for fluid communication, drainage, and/or air flow. The interior channel 114 can accommodate drainage of liquid water intrusion, e.g., due to rain, snow melt, or flooding; and that the channel facilitates or permits air flow, e.g., to permit drying of the insulative panel 1000 in the event of exposure to moisture. The interior channel 114 (also referred to as a channel) provides a clear passage for any moisture that may condense or otherwise form within the insulative panels, and as described below, an insulative system including an assembly of panels 1000 may include flashing with weep holes for drainage of this moisture. The interior channel can include the air space between the inner surfaces 106, 108. In the event panels 102, 104 are formed of a porous material, the pore structures of these panels may also provide drainage and facilitate drying.

Figure 2:
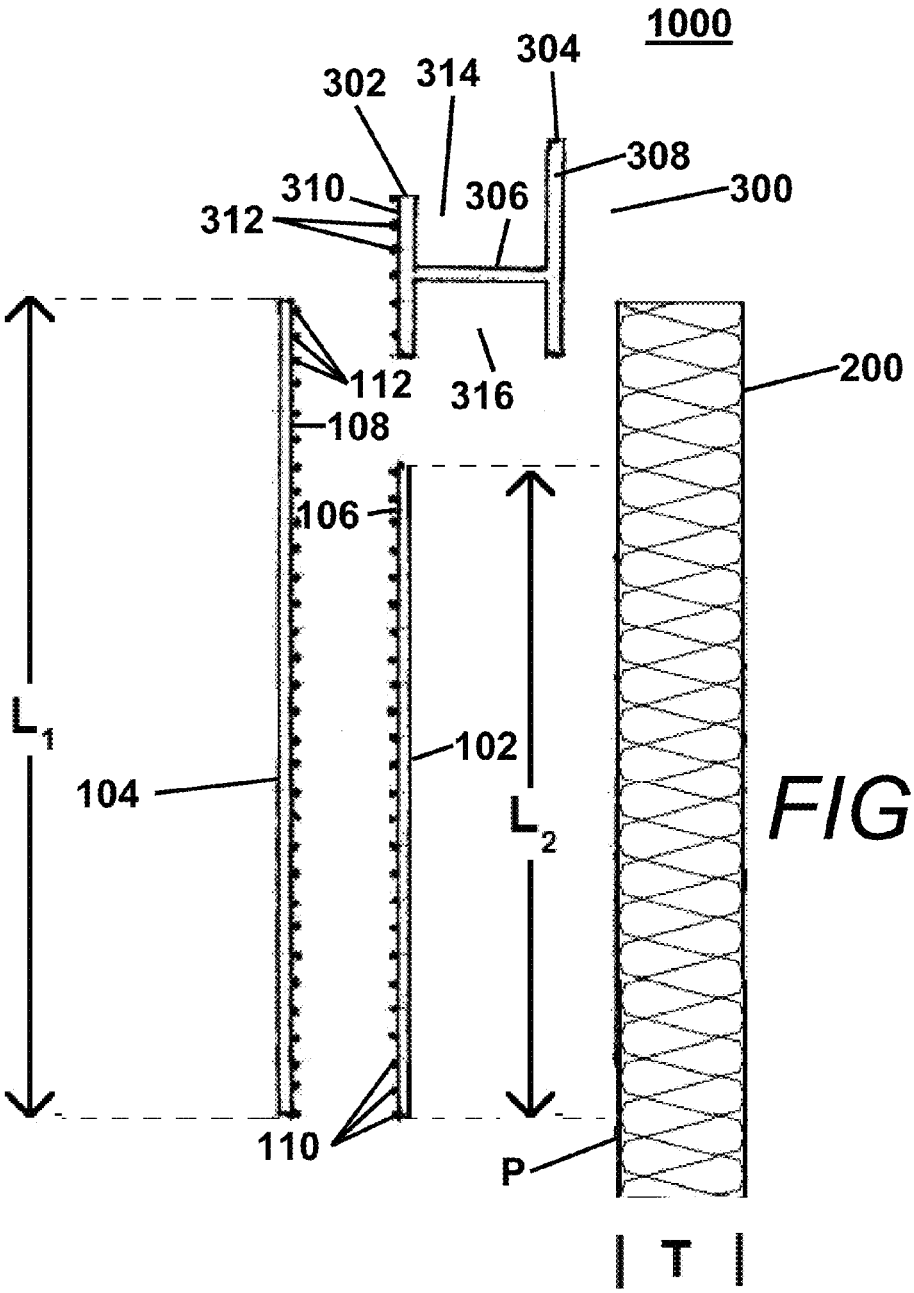
FIG. 2 is a side, cross-sectional view of the insulative panel with parts separated, in accordance with the embodiment of FIG. 1.

In the embodiment seen in FIGS. 1 and 2, the connectors 110, 112 are configured as circular projections, e.g., dimples, that are ⅜" in diameter. The configuration and dimensions of the connectors 110, 112 may be varied in alternate embodiments, however, without departing from the scope of the present disclosure. For example, the connectors 110, 112 maybe square, triangular, elliptical, etc., and may define transverse cross-sectional dimensions either larger or smaller than ⅜". Additionally, although illustrated with connectors identical in configuration and dimensions, the present disclosure contemplates the incorporation of non-identical connectors 110, 112.

In one embodiment of the disclosure, the panes 102, 104 each define a thickness of 3⁄16". The thickness of the panes 102, 104, may be altered or varied in alternate embodiments of the present disclosure to suit a particular need or construction.

The outer pane 104 defines a length $L_1$ (FIG. 2), and the inner pane 102 defines a length $L_2$. In the illustrated embodiment, the panes 102, 104 are dimensioned such that the length $L_1$ exceeds the length $L_2$. In alternate embodiments of the disclosure, however, the panes 102, 104 may be dimensioned such that $L_1$ and $L_2$ are equal, or such that $L_2$ exceeds $L_1$.

With continued reference to FIGS. 1-4, the insulator 200 is positioned adjacent to the inner pane 102, and increases the insulative properties of the panel 1000. In one embodiment, the insulator 200 may include a high-density foam board, e.g., polyisocyanurate rigid insulation. Alternatively, the insulator 200 may include any material that creates a suitable thermally insulative barrier, either exclusively, or in combination with other materials. In various embodiments, it is also envisioned that the insulator 200 may include water resistant properties, e.g., a coating, film, or the like, and/or that the insulator 200 may be formed from a plurality of layers of material laminated or otherwise secured together.

The insulator 200 defines a thickness T (FIG. 2) that can be varied to create any desired insulative value. For example, in the embodiment of the disclosure illustrated in FIG. 2, the thickness T is approximately 3". A thickness T in the range of 1½"-12" is also contemplated herein.

Figure 3:
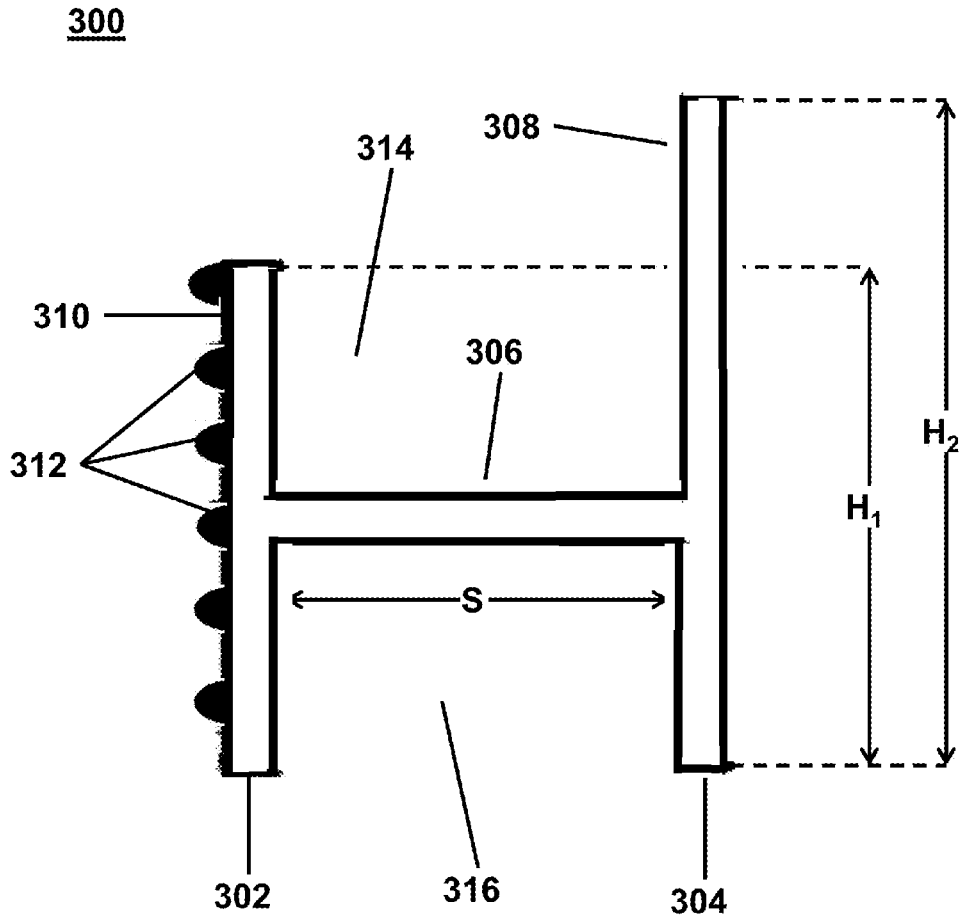
FIG. 3 is a side, cross-sectional view of the clip of the embodiment of FIGS. 1 and 2.
Figure 4:
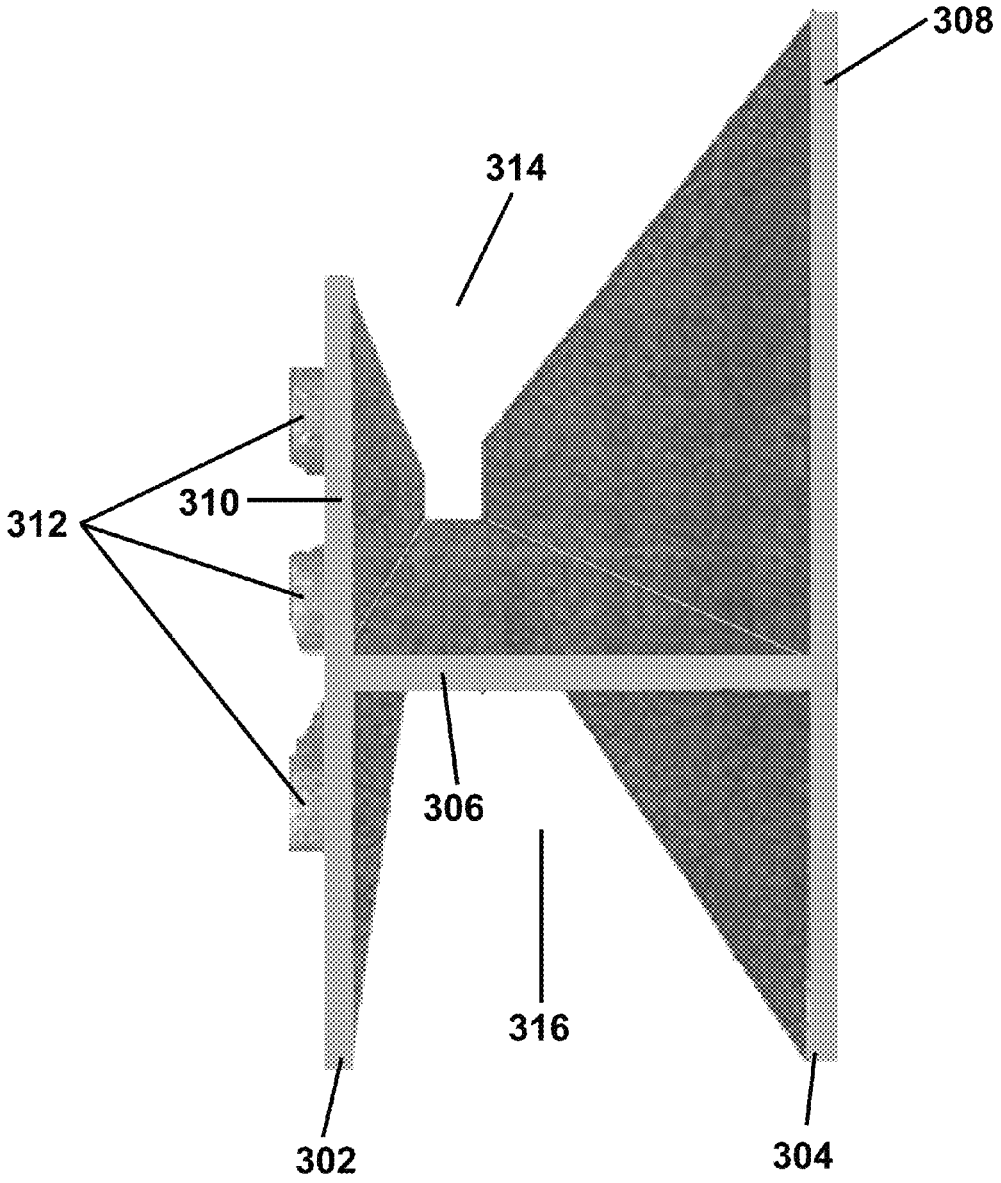
FIG. 4 is a perspective, end view of the clip of the embodiment of FIGS. 1 and 2.

With reference now to FIGS. 3 and 4 in particular, the clip 300 will be discussed. The clip 300 is configured, dimensioned, and adapted to connect the panes 102, 104 (FIGS. 1, 2) and the insulator 200, and may be formed from any material suitable for this intended purpose. For example, the clip 300 may be formed from the same material as the panes 102, 104, e.g., PET, or alternatively, the clip 300 may be formed from a different material, e.g., acrylonitrile butadiene styrene (ABS). To maximize efficiency of the insulative panel 1000 (FIGS. 1 and 2), it is envisioned that the clip 300 may also be formed from a material that limits heat conduction.

The clip 300 includes a outer arm 302, a inner arm 304, and a saddle 306, and is generally H-shaped in configuration. The outer arm 302 defines a height $H_1$, and the inner arm 304 defines a height $H_2$. In the embodiment illustrated in FIGS. 3 and 4, the arms 302, 304 are dimensioned such that the height $H_2$ exceeds the height $H_1$ so as to define an extension 308 that is configured and dimensioned to receive a plurality of fasteners (not shown) to facilitate connection of the panel 1000 to the edifice, as discussed in further detail below. In certain embodiments, the height $H_1$ may be within the range of 3½"-6½", whereas the height $H_2$ may be within the range of 4½"-7½". In alternate embodiments of the disclosure, however, the arms 302, 304 may be dimensioned such that $H_1$ and $H_2$ are equal, or such that $H_1$ exceeds $H_2$. While the clip 300 has been described with reference to specific ranges of dimensions, it should be understood that these dimensions are merely illustrative and that the subject matter of the present disclosure is compatible with other, additional dimensions.

The outer arm 302 includes an outer surface 310 having a plurality of connectors 312 that are configured and dimensioned for mating engagement with the connectors 112 (FIGS. 1, 2) included on the inner surface 108 of the outer pane 104. For example, the connectors 312, 112 may be configured and dimensioned for mechanical engagement, or may be fused together, e.g., by the application of heat, as discussed above. As seen in FIG. 1, mating engagement of the connectors 312, 112, respectively, included on the outer pane 104 and the outer arm 302 of the clip 300 extends the channel 114.

The connectors 312 included on the clip 300 may vary in size, e.g., diameter. In one particular embodiment, for example, the connectors 312 each define a diameter of ⅜". The present disclosure also contemplates connectors 312 defining larger or smaller diameters. Additionally, although illustrated as being identical in configuration and dimensions, the present disclosure also contemplates the incorporation of connectors 312 that may vary in configuration and/or dimensions.

In one embodiment of the disclosure, the arms 302, 304 each define a thickness of 3⁄16". In alternate embodiments, however, the thickness of the arms 302, 304, may be varied, without departing from the scope of the present disclosure, to suit a particular need or construction.

As seen in FIGS. 3 and 4, the arms 302, 304 and the saddle 306 collectively define upper and lower chambers 314, 316 that are located on opposite sides of saddle 306. The saddle 306 connects the arms 302, 304 and defines a span S that is dimensioned to accommodate the insulator 200 such that the insulator 200 is securely positionable between the arms 302, 304, i.e., within the lower chamber 316, as seen in FIG. 1. Consequently, the span S defined by the saddle 306 will generally correspond to the thickness T (FIG. 2) defined by the insulator 200. For example, in the embodiment of the disclosure illustrated in FIGS. 1 and 2, the span S is approximately 3", but may vary from 1.5"-6" in alternate embodiments of the disclosure.

Figure 5:
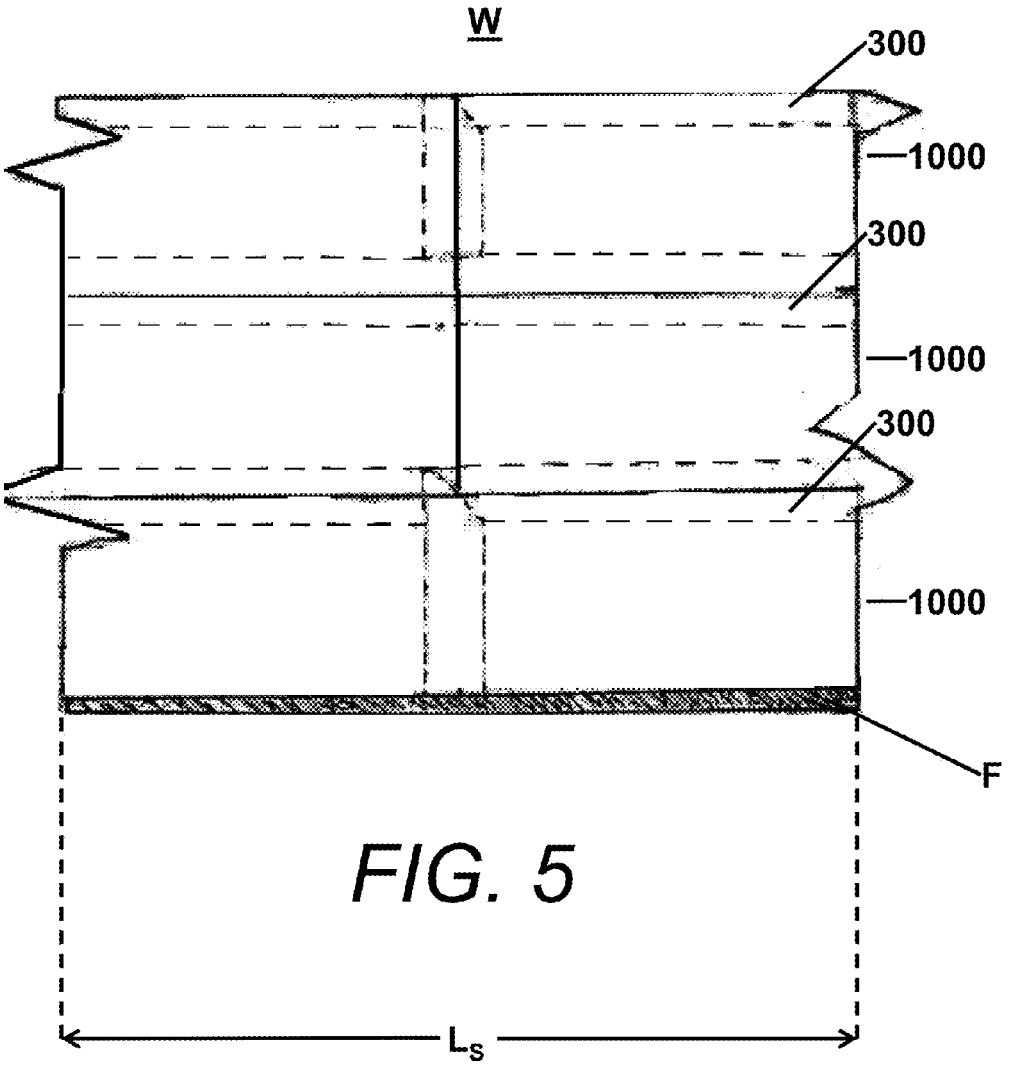
FIG. 5 is a front, elevational view of a series of insulative panels secured together to form an insulative system configured as a wall, in accordance with an embodiment.
Figure 6:
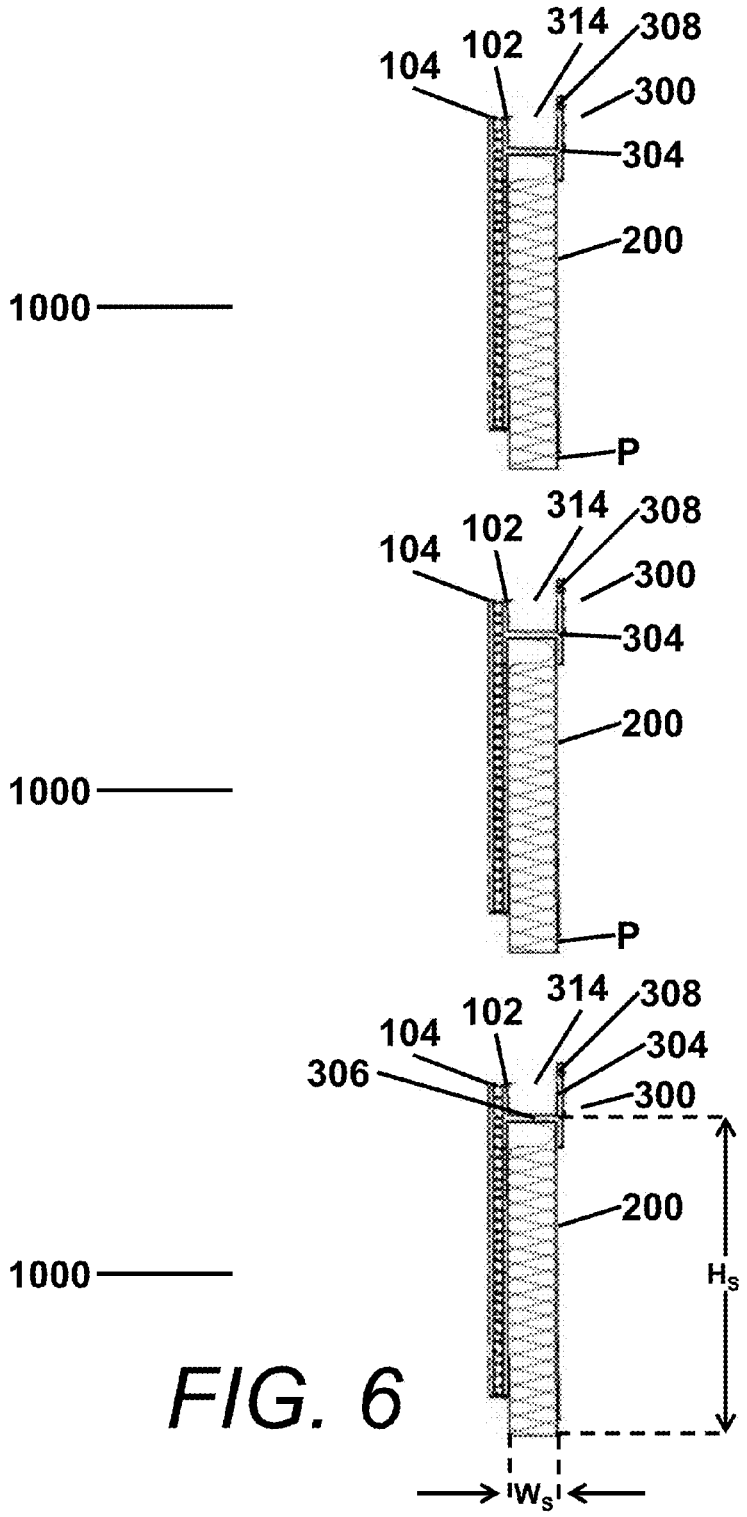
FIG. 6 is a side, cross-sectional view illustrating the plurality of insulative panels of the embodiment of FIG. 5, prior to connection.
Figure 7:
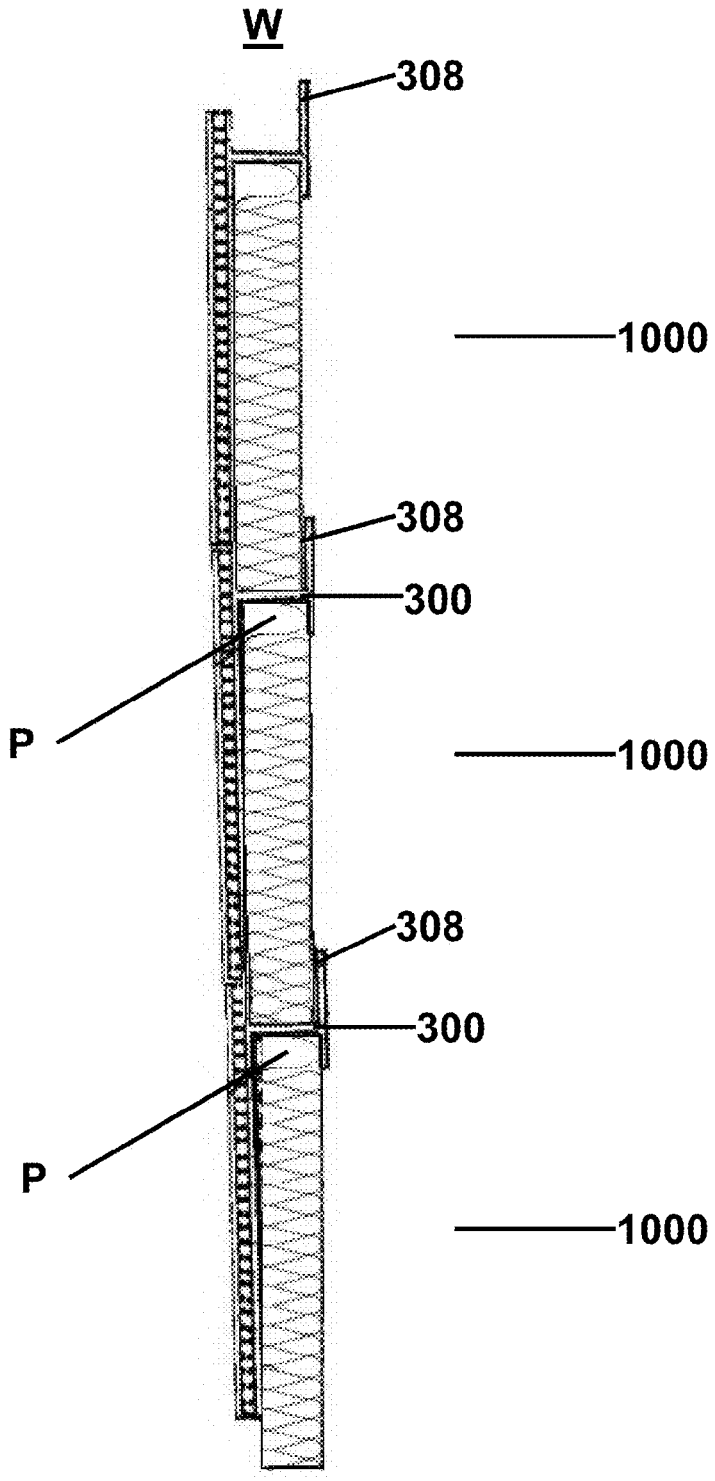
FIG. 7 is a side, cross-sectional view illustrating the plurality of insulative panels of the embodiment of FIG. 5, following connection.

With reference now to FIGS. 5-7, each panel 1000 defines an overall length $L_S$ (FIG. 5), a height $H_S$ (FIG. 6), and a width $W_S$ (FIG. 6). The height $H_S$ (FIG. 6) is measured from the bottom of the insulator 200 to the midpoint of the saddle 306. In various embodiments, these dimensions provide sufficient stability and rigidity to resist forces applied to the panels 1000, e.g., via wind, seismic activity, or other lateral forces, thereby limiting, if not entirely obviating, the need for additional strapping. The length $L_S$ and the height $H_S$ of the panel 1000 may be varied, or cut to size, however, depending on the particular application in which the panel 1000 is employed. Additionally, the width $W_S$ of the panel 1000 is customizable depending on the intended use of the panel 1000, and the insulative value that is desired. For example, in those instances requiring added insulative value, the span S (FIG. 3) of the saddle 306 may be increased so as to accommodate increased thickness T in the insulator 200.

As seen in FIGS. 5-7, a series of panels 1000 may be connected to form an insulative system, or wall W. Specifically, each insulator 200 extends beyond, i.e., below, the panes 102, 104 of the corresponding panel 1000 such that a lower portion P (FIGS. 1, 2, 6, 7) is positionable within the upper chamber 314 defined by the clip 300 of an adjacent panel 1000. In FIG. 5, the dashed lines depict the edges of clips 300 concealed within the panes of the panels 1000. The lower portion P of the insulator 200 can then be connected to the clip 300, e.g., via pressure fitting and/or sealing with an adhesive, such as contact cement or silicone adhesive. By stacking the panels 1000, the height of the wall W can be customized according to the requirements of any insulative application.

The panels 1000 are manufactured through a molding process, e.g., injection molding. Specifically, a first mold is utilized to form the panes 102, 104 (FIGS. 1, 2), which can then be positioned in mating engagement in the manner discussed above, e.g., by fusing the connectors 110 on the inner pane 102 with the connectors 112 on the outer pane 104. After engagement of the panes 102, 104, the assembled panes 102, 104 are laminated with the insulator 200, e.g., via an adhesive, such as contact cement. In an exemplary assembly process, at a first step the inner pane 102 is laminated to the insulator 200. At a second step, the clip 300 is pressure fitted to the insulator 200. Then, the connectors 112 of outer pane 104 are simultaneously fused to the connectors 110 of inner pane 102 and to the connectors 312 of the clip 300.

A second mold is utilized to form the clip 300, which can be secured to the assembly of the panes 102, 104 and the insulator 200, e.g., via pressure-fitting and sealing at the interface between the insulator 200 and the clip 300, and at the interface between the clip 300 and the inner pane 102.

With reference now to FIGS. 5-7, use and installation of the insulative panels 1000 will be described. Initially, after framing and sheathing has been completed, a starter track F (FIG. 5) is installed using a laser level across the bottom of a wall. As used in the present disclosure, a starter track is a portion of the system for insulating an edifice that is configured to secure insulative panels 1000 to the foundation wall of the edifice. For brick applications, a steel angle must be installed at the floor header or foundation wall to support brick. A panel 1000 is then installed horizontally over the starter track, i.e., such that the length $L_S$ of the panel 1000 is oriented in generally parallel relation to the ground. The panel 1000 is then secured to the edifice using one or more fasteners (not shown), e.g., screws. For example, the panel 1000 may be fastened via the placement of screws through the extension 308 (see also FIG. 3) defined by the inner arm 304, which is then overlaid with another panel 1000 upon positioning of the insulator 200 within the upper chamber 314, which reduces thermal bridging through mechanical fasteners to the edifice. The simplicity of the installation process drastically reduces the required labor, thereby reducing the overall cost of the build.

Corners and windows are pressure-fitted and sealed, e.g., with thermal mastic, caulking, or the like, and at the eaves level, flashing is installed on the overhang framing sandwiching the panels 1000 against the wall framing, and is thereafter sealed, e.g., with thermal mastic, caulking, or the like.

In an embodiment, seams are then sealed with a water-impermeable membrane to maximize moisture resistance, and application of siding, brick, and the like can begin.

Figure 8:
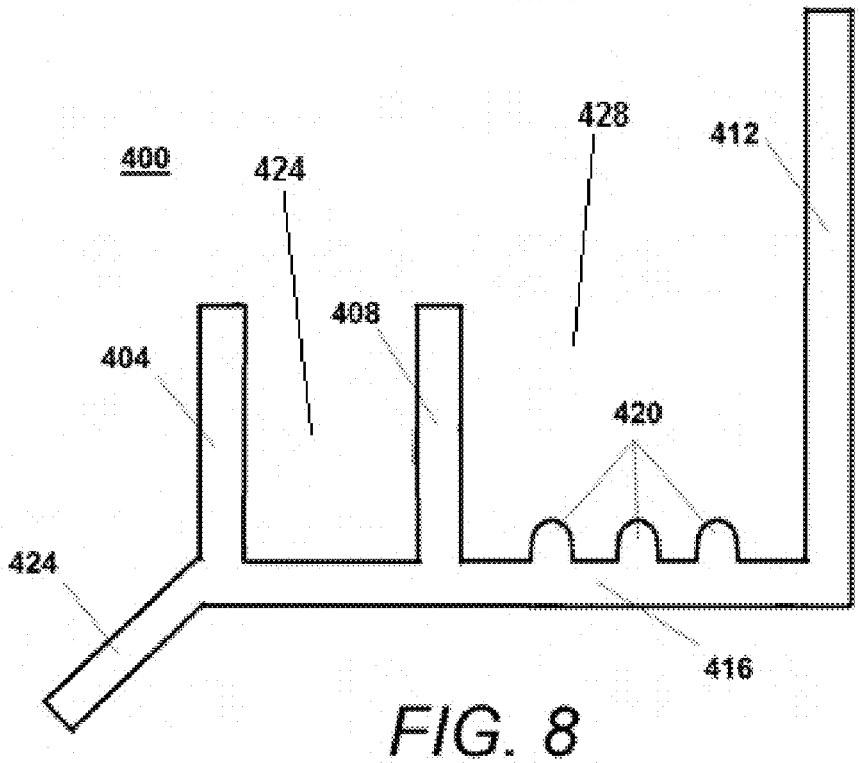
FIG. 8 is a side, cross-sectional view of a starter track in accordance with an embodiment.
Figure 9:
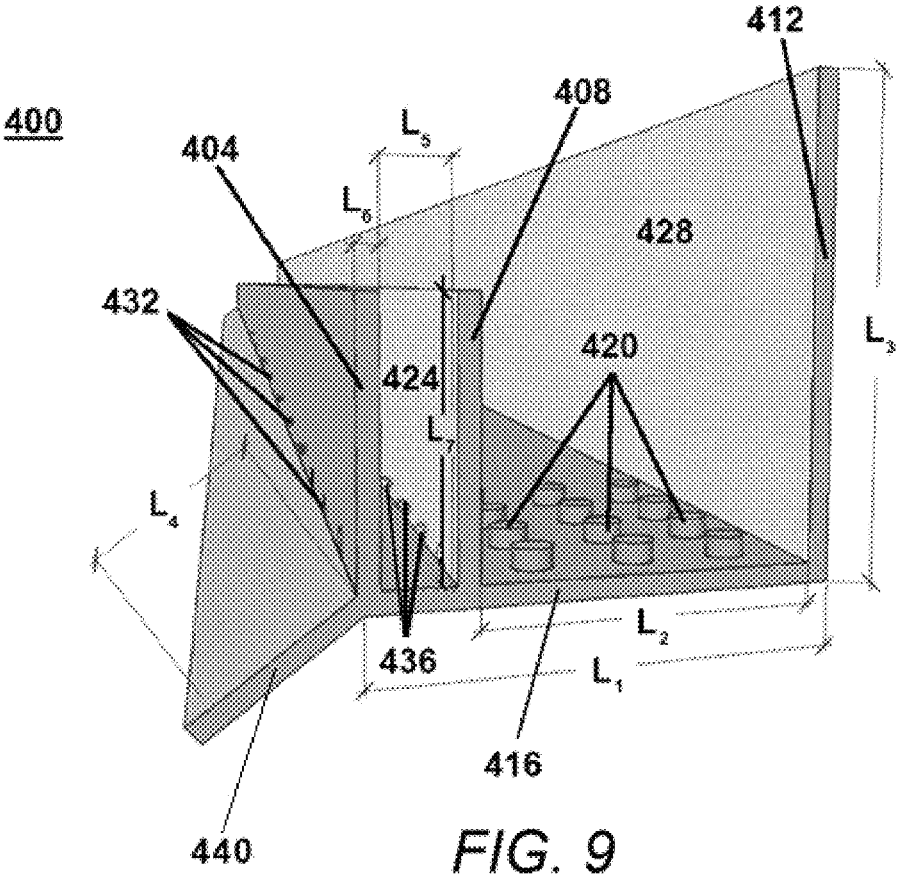
FIG. 9 is a perspective, end view of the starter track of the embodiment of FIG. 8.
Figure 10:
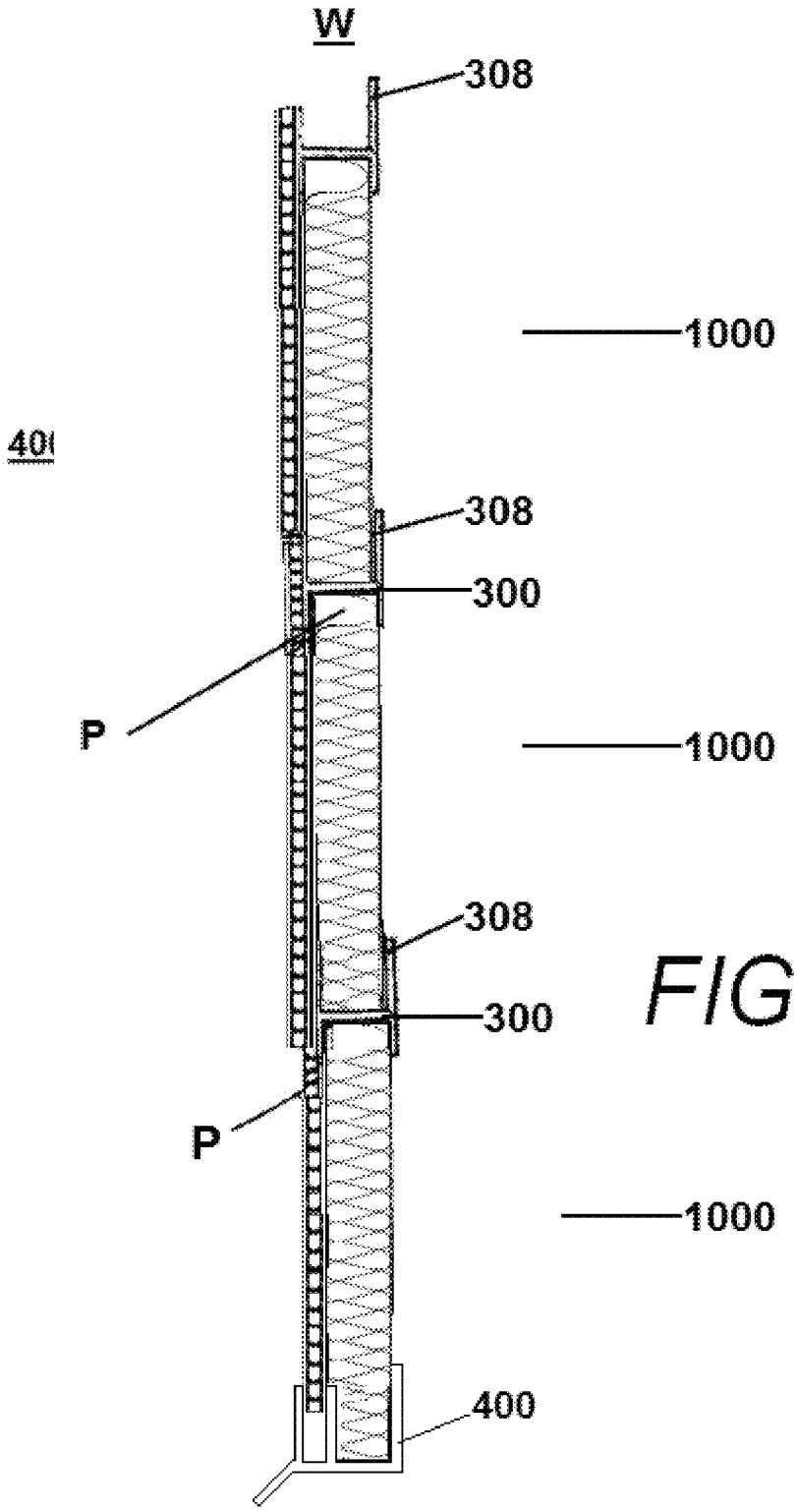
FIG. 10 is a side, cross-sectional view illustrating a plurality of connected insulative panels, including a lowermost insulative panel secured to the starter track of the embodiment of FIG. 8.

With reference now to FIGS. 8-10, a further starter track 400 will be discussed. The starter track 400 is configured, dimensioned, and adapted to receive insulative panels 1000 including the panes 102, 104 (FIGS. 1, 2) and the insulator 200, and to secure these panels to the foundation wall of the edifice. The starter track 400 may be formed from any material suitable for this intended purpose. For example, the starter track 400 may be formed from the same material as the panes 102, 104, e.g., PET, or alternatively, the starter track 400 may be formed from a different material, e.g., acrylonitrile butadiene styrene (ABS) or the like. To maximize efficiency of the insulative panel 1000 (FIGS. 1, 2), it is envisioned that the starter track 400 may also be formed from a material that limits heat conduction.

The clip 400 includes an outer arm 404, an intermediate arm 408, an inner arm 412, and a saddle 416. The outer arm 404 and the intermediate arm 408 define a height $L_7$, and the inner arm 412 defines a height $L_3$. In the embodiment illustrated in FIGS. 8 and 9, the arms 404, 408, and 412 are dimensioned such that the height $L_3$ exceeds the height $L_7$ so as to define an extension 414. Extension 414 is configured and dimensioned to receive a plurality of fasteners (not shown) to facilitate connection of the panel 1000 to an exterior base of the foundation wall of the edifice, as discussed in further detail below. For example, an illustrative height $L_7$ is in the range of 2½" to 4½", whereas an illustrative height $L_3$ is 4⁹⁄₁₆" In alternate embodiments of the disclosure, however, the arms 404, 408, and 412 may be dimensioned such that $L_7$ and $L_3$ are equal, or such that $L_7$ exceeds $L_3$. In the illustrated embodiment, the total length $L_1$ of the saddle 416 may be approximately 4⅛". In the illustrated embodiment, the outer arm 404, intermediate arm 408, and inner arm 412 may have a thickness $L_6$ of about ³⁄₁₆".

As seen in FIGS. 8 and 9, the outer arm 404, intermediate arm 408, and the saddle 416 collectively define an outer chamber 424 located above saddle 416 on an outer portion of starter track 400. The intermediate arm 408, inner arm 412, and the saddle 416 collectively define an inner chamber 428 located above saddle 416 at an inner portion of starter track 400.

The saddle 416 connects the arms 408, 412 and defines a span $L_2$ that is dimensioned to accommodate the insulator 200 such that a lowermost portion of the insulator 200 of the panel 1000 is securely positionable between the arms 408, 412, i.e., within the inner chamber 428, as seen in FIG. 10. Consequently, the span $L_2$ defined between the arms 408 and 412 above the saddle 416 will generally correspond to the thickness T (FIG. 2) defined by the insulator 200. For example, in the embodiment of the disclosure illustrated in FIGS. 1 and 2, the span $L_2$ is approximately 3", but may vary from 1½"-12" in alternate embodiments of the disclosure.

As seen in FIG. 10, a lowermost portion of the insulator 200 is received within the inner channel 428 of starter track 400. As seen in FIG. 9, the saddle 416 includes an upper surface between arms 408, 412, and may include a plurality of dimples 420. If included, dimples 420 are configured to support the insulator 200 above the upper surface of saddle 416 between arms 408, 412 to allow for efficient drainage from insulator 200.

The saddle 416 connects the arms 404, 408 and defines a span $L_5$ that is dimensioned to accommodate the joined inner and outer panes 102, 104 of the panel 1000. A lowermost portion of the inner and outer panes 102, 104 is received between the arms 404, 414, i.e., within the outer chamber 424, as seen in FIG. 10. Consequently, the span $L_5$ defined between the arms 404 and 408 above the saddle 416 will generally correspond to a thickness defined by the joined inner and outer panes 102, 104.

As seen in FIG. 10, a series of panels 1000 may be connected to form an insulative system, or wall W, with a lowermost panel 1000 fastened within the starter track 400, which acts as the first saddle for the interconnected series of panels. In an embodiment, the starter track 400 is fastened to the exterior base of the foundation wall of an edifice. A series of starter tracks 400 may be installed around the foundation perimeter of the edifice surface to be cladded.

In an embodiment, the starter track 400 serves as flashing, and is formed of a water-impervious material that provides a weather-resistant barrier. In certain embodiments, a series of weep holes 436 are spaced along the base of intermediate arm 408, and a series of weep holes 432 are spaced along the base of outer arm 404, to allow water to drain from the chamber 428 containing the insulator 200, and to drain from the chamber 424 containing the inner and outer panes 102, 104. The starter track 400 also includes a graded drainage panel 440 that provides positive drainage away from the starter track and from the panels 1000 anchored at the starter track. In an exemplary embodiment, the drainage panel has a length $L_4$ of approximately 1½", and the weep holes 432, 436 have a diameter of around ⅜". In certain embodiments, the angle between inner arm 412 and saddle 416 is increased (to an angle above 90°) in order to improve drainage.

While the starter track 400 has been described with reference to specific dimensions and ranges of dimensions, it should be understood that these dimensions are merely illustrative and that the subject matter of the present disclosure is compatible with other, additional dimensions.

While the present disclosure has been described in connection with specific, illustrative embodiments, it should be understood that the subject matter of the present disclosure is capable of further modifications. For example, persons skilled in the art will understand that additional components and features may be added to any of the embodiments discussed herein above, and that those elements and features described in connection with any one embodiment may also be applicable to, or combined with, those of any other embodiment without departing from the scope of the present disclosure.

The scope of the present disclosure is intended to cover any variations, uses, and/or adaptations of the presently disclosed subject matter in accordance with the principles of the present disclosure, including such departures from the present disclosure as come within known or customary practice within the art to which the present disclosure pertains, and as may be applied to the elements, components, and features set forth herein above.

What is claimed is:

1. A panel for use in insulating an edifice, the panel comprising:

a first pane;

a second pane in engagement with the first pane so as to define a channel therebetween, wherein the first and second panes are separate and each includes a plurality of connectors, the connectors of the first pane being engaged with the connectors of the second pane;

a clip in engagement with the first and second panes; and an insulator including an upper portion positioned within the clip.

2. The panel of claim 1, wherein the connectors of the first pane are positioned on an inner surface of the first pane, and the connectors of the second pane are positioned on an inner surface of the second pane, the inner surfaces of the first and second panes facing each other.

3. The panel of claim 2, wherein the connectors of the first pane and the connectors of the second pane are fused together.

4. The panel of claim 1, wherein the clip includes an inner arm, an outer arm, and a saddle extending between the inner and outer arms.

5. The panel of claim 4, wherein the clip is generally H-shaped in configuration, wherein the inner arm and outer arm each define a length, and wherein the length of the inner arm is greater than the length of the outer arm so as to define an extension configured and dimensioned to receive a plurality of fasteners.

6. The panel of claim 4, wherein the inner and outer arms each define a length, the length of the inner arm being greater than the length of the outer arm so as to define an extension configured to receive a plurality of fasteners to facilitate connection of the panel to the edifice.

7. The panel of claim 4, wherein the clip defines upper and lower chambers positioned between the inner and outer arms on opposite sides of the saddle.

8. The panel of claim 7, wherein the lower chamber is configured and dimensioned to receive the insulator.

9. A system for use in insulating an edifice, the system comprising:

a first panel comprising:

first inner and outer panes defining a first channel therebetween configured for drainage and air flow, wherein the first inner and outer panes are separate and engaged with each other;

a first clip in engagement with the first inner and outer panes; and a first insulator including an upper portion positioned within the first clip; and a second panel engageable with the first panel, the second panel comprising:

second inner and outer panes defining a second channel therebetween configured for drainage and air flow, wherein the second inner and outer panes are separate and engaged with each other;

a second clip in engagement with the second inner and outer panes; and a second insulator including an upper portion positioned within the second clip of the second panel, and a lower portion positionable within the first clip of the first panel.

10. The system of claim 9, wherein the first panel and the second panel are identical.

11. The system of claim 9, wherein the first inner and outer panes of the first panel and the second inner and outer panes of the second panel each include a plurality of connectors, the connectors of the first inner and outer panes being engaged with each other, and the connectors of the second inner and outer panes being engaged with each other.

12. The system of claim 11, wherein the connectors are located within the first channel defined between the first inner and outer panes, and are located within the second channel defined between the second inner and outer panes.

13. The system of claim 12, wherein the connectors of each of the first inner pane and the second inner pane are fused to the connectors of respective of the first outer pane and the second outer pane.

14. The system of claim 9, wherein each of the first clip and the second clip includes a first arm, a second arm, and a saddle extending between the first and second arms so as to define upper and lower chambers positioned between the first and second arms on opposite sides of the saddle.

15. The system of claim 14, wherein the first and second panels are arranged in vertical relation.

16. The system of claim 15, wherein the second insulator of the second panel is positionable within the upper chamber defined by the first clip of the first panel.

17. The panel of claim 1, wherein the channel defined between the first pane and second pane is configured for drainage and air flow.

* * * * *